US009883552B2

(12) United States Patent
Nangle

(10) Patent No.: US 9,883,552 B2
(45) Date of Patent: Jan. 30, 2018

(54) HEAT GENERATOR

(75) Inventor: Douglas Nangle, Chipping Camden (GB)

(73) Assignee: ROTAHEAT LIMITED, Salisbury (GB)

( * ) Notice: Subject to any disclaimer, the term of this patent is extended or adjusted under 35 U.S.C. 154(b) by 882 days.

(21) Appl. No.: 13/704,844

(22) PCT Filed: Jun. 15, 2011

(86) PCT No.: PCT/GB2011/051120
§ 371 (c)(1),
(2), (4) Date: Dec. 17, 2012

(87) PCT Pub. No.: WO2011/158030
PCT Pub. Date: Dec. 22, 2011

(65) Prior Publication Data

US 2013/0092681 A1 Apr. 18, 2013

(30) Foreign Application Priority Data

Jun. 16, 2010 (GB) ..... 1010048.5

(51) Int. Cl.
*H05B 6/00* (2006.01)
*H05B 6/10* (2006.01)

(52) U.S. Cl.
CPC ..... *H05B 6/108* (2013.01)

(58) Field of Classification Search
CPC ..... H05B 6/10; H05B 6/108; H05B 6/109
USPC ..... 219/628, 629, 630, 631, 672
See application file for complete search history.

(56) References Cited

U.S. PATENT DOCUMENTS

| | | | | |
|---|---|---|---|---|
| 4,217,475 | A * | 8/1980 | Hagerty | 219/631 |
| 4,486,638 | A * | 12/1984 | de Bennetot | 219/631 |
| 4,511,777 | A | 4/1985 | Gerard et al. | |
| 5,914,065 | A * | 6/1999 | Alavi | 219/631 |
| 6,297,484 | B1 | 10/2001 | Usui et al. | |
| 6,489,598 | B1 * | 12/2002 | Hielm | 219/631 |
| 2003/0066830 | A1 | 4/2003 | Reed et al. | |
| 2005/0006381 | A1 * | 1/2005 | Lunneborg et al. | 219/672 |

FOREIGN PATENT DOCUMENTS

| | | | |
|---|---|---|---|
| EP | 0077702 | A2 | 4/1983 |
| EP | 0579073 | A | 1/1994 |
| GB | 2336751 | A | 10/1999 |
| JP | 2000123962 | A1 | 4/2000 |
| WO | WO0078569 | A2 | 12/2000 |
| WO | WO02087285 | A1 | 10/2002 |

OTHER PUBLICATIONS

English translation of JP 2000-123962 to Inoue, published Apr. 2000.*

* cited by examiner

*Primary Examiner* — Michael LaFlame, Jr.
(74) *Attorney, Agent, or Firm* — Nixon & Vanderhye P.C.

(57) ABSTRACT

A heat generator comprises a rotatable magnetic field and a heat exchanger (26) including a fluid path (45) for water set into an electrically conducting disc. An entry to and exit from the fluid path is provided for the water. Heat generated by rotating the magnetic field is transferred to water passing though the fluid path in the electrically conducting disc.

16 Claims, 6 Drawing Sheets

HEAT GENERATOR

This invention relates to a heat generator especially to convert kinetic rotational energy into heat energy.

Eddy current heaters are used to convert rotational energy into heat energy.

An example of such a system can be found in PTL 0001: U.S. Pat. No. 6,297,484 B (USUI). Oct. 2, 2001.

USUI describes and claims a magnetic heater of the type in which a magnet and a conductor are disposed so as to face to each other leaving a slight gap and heat transferring fluid is heated by slip heat which is generated in said conductor by relatively rotating said magnet and said conductor, and in which the heater comprises a permanent magnet fixed to a housing supported on a driving shaft via a bearing; and a flat disc-like conductor facing to said permanent magnet while leaving a slight, constant gap provided rotably to said driving shaft within said housing; with the heat transferring fluid introduced to the inside of said housing being in fluid communication with said disc-like conductor, said heat transferring fluid being heated by the slip heat generated in said conductor as said disc-like conductor rotates.

In one embodiment of USUI the disc-like conductor is a rotary water jacket.

USUI further claims an embodiment in which the disc-like conductor comprises a magnetic material having an eddy-current member pasted on a surface of said magnetic material. Furthermore the disc-like conductor comprises a back plate being a core member for concentrating magnetic fields generated by said permanent magnet to said disc-like conductor. According to the present invention a heat generator comprises a rotatable magnetic field and a heat exchanger having an electrically conducting disc with having a fluid path therein and with an entry to and exit, in which heat generated by rotating the magnetic field may be transferred to fluid passing though the fluid path.

Currently energy generated by wind power and other renewable energy devices is almost exclusively geared towards producing electricity. It is inefficient to use this renewably produced electricity to convert this to heat, and as a result almost no attempt is made to reduce the usage of natural gas and other fossil fuels for the production of heat energy. For this application eddy current heaters have considerable potential but the existing heaters as exemplified by embodiments of USUI do not operate as efficiently as they could because the heat transfer from the conductor is limited, with the result that the conductor heats up; at higher temperatures eddy current heaters are less efficient and the efficiency of conversion of rotating energy input energy to heat energy declines, furthermore the structure of USUI prevents the use of multiple heaters in one device which would enable greater energy extraction, and the large inertia of the water jacket design makes starting and stopping difficult.

In its widest aspect in the present invention a heat generator comprises a magnetic field which intersects a heat exchanger characterised in that the heat exchanger comprises a first flat plate that is both electrically conducting, said first plate having a fluid path in the plane of the plate and wherein heat generated in said plate induction as a result of relative movement of the magnetic field with respect to the plate is transferred to any fluid in the fluid path.

In a preferred embodiment the heat generator comprises a magnetic field which is both rotatable about a shaft and intersects a heat exchanger that characterised in that the heat exchanger comprises a flat first disc that is both electrically conducting and is disposed around the shaft, but not attached thereto, said first disc having a fluid path in the plane of the disc wherein heat generated in the first disc by induction as a result of rotating the magnetic field is transferred to any fluid in the fluid path.

By passing the fluid through the first disc heat transfer is very efficient, preventing the disc from over-heating with the added bonus that the disc need not be thick, allowing several such heater exchangers to be mounted in parallel around a single shaft, so that maximum energy can be extracted from rotary energy of the shaft. The entry and exit to the fluid path may be disposed on the periphery of the first disc, avoiding difficult couplings and potential sources of leakages inherent in known heaters of this kind.

In a preferred arrangement the heat generator of this invention additionally comprises two further flat discs which will generate heat under the influence the rotatable magnetic field as a consequence of their being electrically conducting. The first disc is then sandwiched between these two further discs.

In a particularly high performing embodiment of the invention the heat generator of the invention has the entry and outlet to the fluid path are disposed in close proximity to one another on the periphery of the first disc and the fluid path is sinuous extending substantially around the outside to the shaft but within the plane of the disc. A serpentine path ensures to the whole area of the disc is covered. Having the fluid path for internal heat transfer within the first disc path convoluted increases the surface area available for heat transfer and allows for dimensions that will control the flow rate of heat transfer fluid through the disc to remove heat from inside the heat generator/exchanger at a rate that prevents the magnets overheating and losing efficiency in the process In a further embodiment a generator according to the invention comprises a plurality of the heat exchangers, each disposed between pairs of rotatable discs having magnets attached facing a heat exchanger, and in which any of the rotatable discs that is between two heat exchangers has magnets disposed on both sides of the disc.

Conveniently the fluid used for heat transfer is water. In order to ensure the maximum take up of heat, it may be desirable to suppress boiling of the water by using pressurized water or water containing anti-freeze or another additive to raise its boiling point. Other fluids may also be used, liquids, such as oils having a higher boiling point than water are particularly useful.

Alternatively the fluid can be water vapour (steam) or indeed a water steam combination where heat is removed from the first disc in part by heat absorption caused by evaporation of the water.

Ideally a heat generator according to this invention is such that the fluid path is part of a closed loop heating system.

Normally in the heat generator of this invention the heater exchanger and other conducting discs are aluminium or aluminium allow, by there is no reason why other materials such as copper and its alloys which make for good eddy current generators should not be used.

The applicant has found that providing adjustment means, whereby the relative position of the heat exchangers to the pairs of discs having magnets attached can be adjusted can be further enhance the performance.

With water as the heat transfer fluid, it is normally moved by a normal circulation pump. However, it has been found that pressurized water, whose boiling point is therefore above the boiling point of water at normal atmospheric pressure works even better. For many applications the water should contain an anti-freeze which not only prevents freezing, but raises the boiling point of water and enhances performance. Other additives that will raise the normal boiling point of water can also be used. As a further alternative other liquids having boiling points above that of water, such as mineral oils can be used.

Alternatively water vapour can be used as the fluid transfer medium, particularly for use in industrial applications; this improves efficiency, but can bring complications as the vapour has to be generated in the first place.

In any of the systems the fluid path is best as part of a closed loop system, meaning that no heat is wasted A heat generator will, according to the invention will convert kinetic energy in the rotating shaft directly into heat. High efficiencies of energy conversion are possible.

In one embodiment of the invention, the device is coupled to a wind turbine; speeds of rotation are generally low and are even lower as turbine capacities increase. As the rotational speed is slow, larger device components are required, thus larger areas for heat loses are in the system, and this heat loss must be reduced. Heat loss also impacts the performance of permanent magnets within the system as their flux field strength reduces as their temperature increases. If this were allowed to happen, the overall energy required to turn the device would fall having a potentially dangerous effect, by removing the breaking load on the turbine and allowing it to run too fast. By providing insulation around the device and good thermal isolation within the device, this problem can be overcome. In particular, therefore, in such an embodiment it is highly desirable that the electrically conducting discs are thermally insulated, and any means to mount the discs within the generator are also provided with thermal breaks to prevent heat transfer through the mounting means.

The applicant has manufactured several heat generating devices using ordinary water as the heat transfer fluid and has shown a 92% conversion rate from the rotational energy at the shaft input to heated water output using a 6 KW device that has been designed to be coupled to a wind turbine of the same size with a shaft speed of up to 200 RPM. They found that using oil as the heat transfer liquid, temperatures up to 200° C. were attained, but at that temperature the magnets lost their magnetic properties until they cooled down. Adjusting the design of the path for the heat transfer liquid as well as the rate of fluid flow allowed them to extract the heat, preventing overheating and thereby attained the 92% efficiency of conversion of rotational energy into heat.

When coupled to a wind turbine, difficulties can arise when starting at very low wind speeds. Since a turbine has blades which are angled or pitched to produce the best performance at the normal operating speeds, rotational shaft torque is reduced at start or low speeds due to low winds.

Therefore in another aspect of the invention a governing device to increase/decrease magnetic flux density as and when required is incorporated.

Although particularly useful for use with wind turbines, the device of this invention can be used with any renewable energy sources capable of producing an output through a rotating shaft, wave energy devices being particularly appropriate. Whilst the preferred design uses rotational motion, eddy currents can also be generated in an up/down motion where the magnet moves across the face of conducting metal plate. Such a design using the fluid path described in this invention could be simpler to implement in conjunction with a wave energy device. In such a case the disc(s) making up the heat exchanger described in paragraphs [0008] et seq above would be replaced by flat plates.

Other optional features of the invention are set out in the description below and the claims.

The invention will now be described with reference to the accompanying figures.

Figure 1:
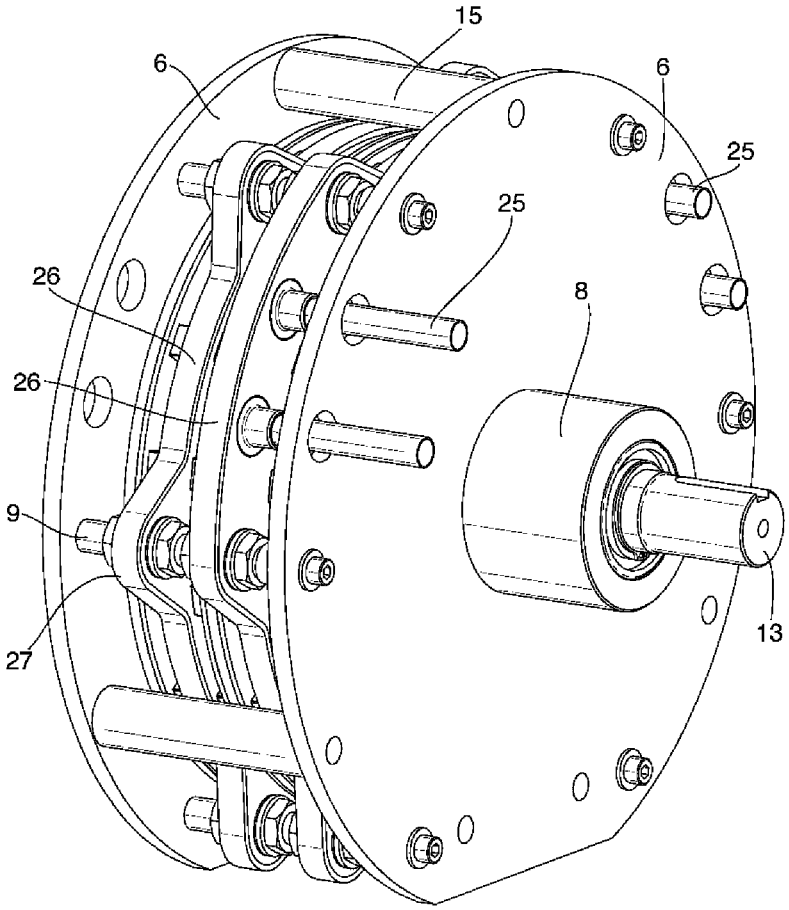
FIG. 1 is an isometric view showing the main components of a heat generator according to the invention.
Figure 2:
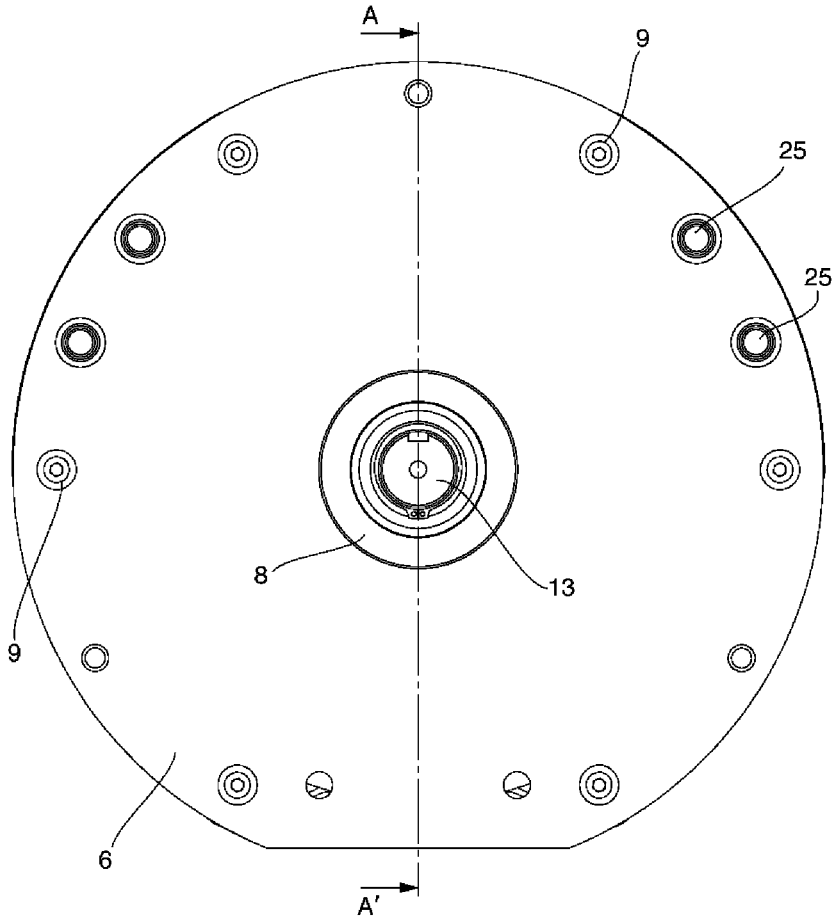
FIG. 2 is an end on view of the device showing the rotatable shaft.
Figure 3:
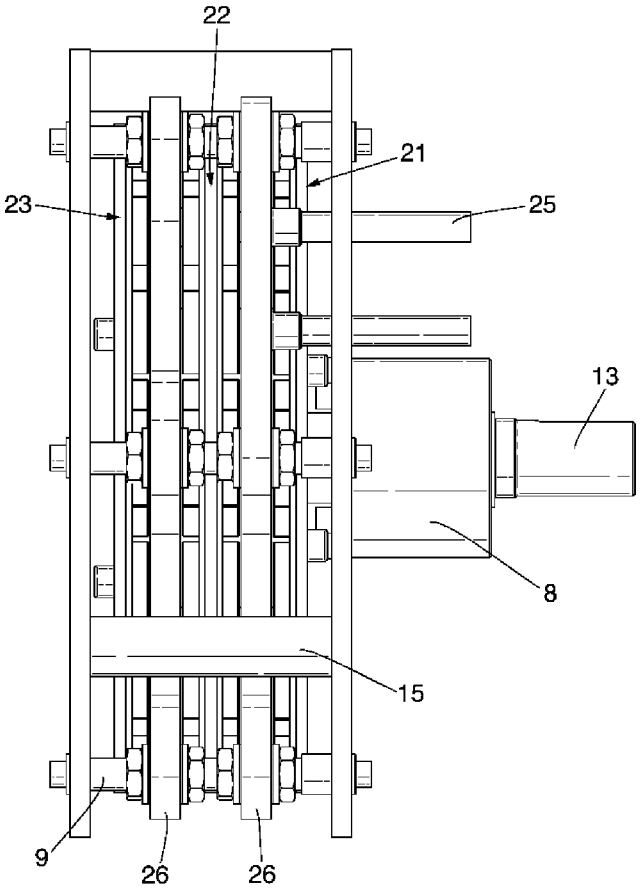
FIG. 3 is a side view of the device.
Figure 4:
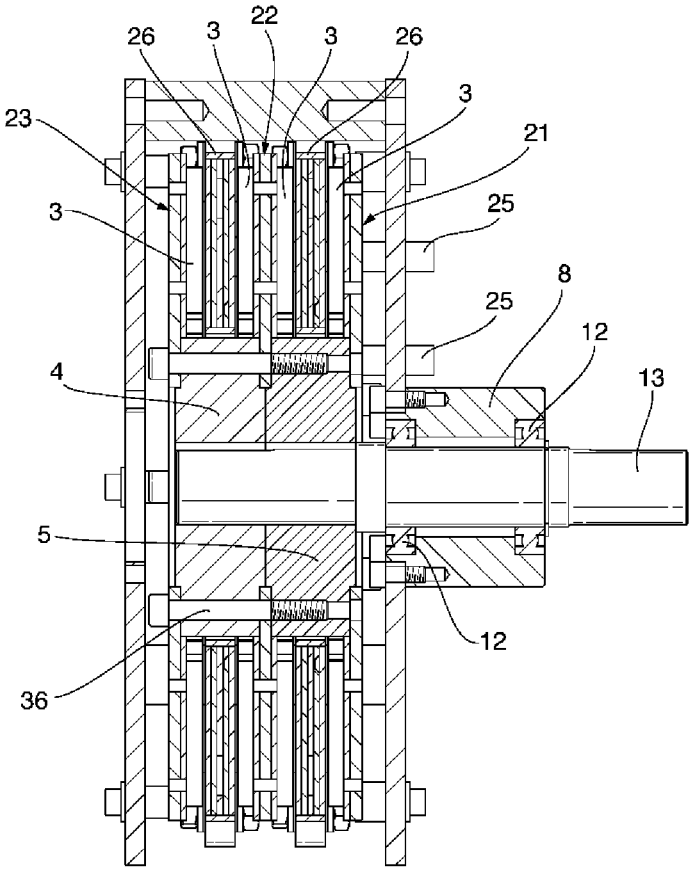
FIG. 4 is a section on the line A-A' of FIG. 2.

FIGS. 1 to 4 give are overall views of the generator, for clarity enclosing covers and overall insulation and bracketing have been omitted. An input shaft 13 passes through an end plate 6 and is held axially and torsionally by bearings within housing 8. Shaft 13 is connected, in this case, to the output of a wind generator (not shown). The frame of the generator comprises two end plates 6 joined by spacers 15. The end plates 6 and spacers 15 make up the main structural frame of the device. Between the end plates are mounted two heat exchange assemblies 26 in this device. The heat exchanger assemblies comprise flat toroidal discs (41, 42, 43 seen detail in FIG. 8), disposed laterally to shaft 13 but not connected thereto, with shaft 13 passing through a hole at the centre of the heat exchangers. Although two heat exchangers assemblies are shown, the number can be varied to suit the input and output requirements of the generator design. Heat transfer fluid pipes 25 pass through the end plate 6 and provide the heat transfer fluid flow entry and return pipes to the heat exchange assemblies 26.

The shaft 13 is mounted in bearings 12 within housing 8. Mounted on shaft 13 are magnetic housing disc mounting bosses 4 and 5. Mounting bosses 4 and 5 transfer rotation of the shaft to rotatable disc assemblies 21, 22 and 23. Three rotatable discs are present in this design, the two outer disc assemblies 21 and 23, having permanent magnets 3 mounted on one side only, and a double sided rotatable disc 22 having permanent magnets mounted on both sides of the disc. The outer assemblies are disposed to rotate close to the outer sides of the heat exchange assemblies 26, and the double sided rotatable disc assembly 22 to rotate between the heat exchanger assembles 26. The heat exchanger assemblies 26 are held in position relative to the end plates 6 by mounting bars 9 passing through wings 27 on the heat exchangers and into the end plates 6 (see detail in FIG. 1). Permanent magnets 3 are disposed radially around the rotatable disc assembles 21, 22, and 23.

Figure 5:
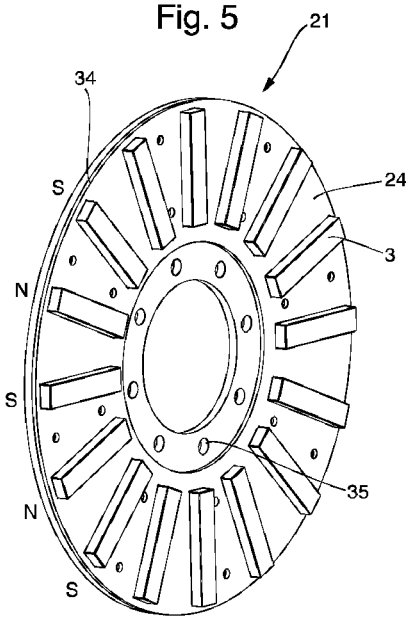
FIG. 5 is a perspective view of a magnetic assembly used in the invention.

One of the rotatable disc assemblies 21 is shown in more detail in FIG. 5. The permanent magnets 3 are formed on a steel disc 24, itself mounted on a steel disc 34, having holes 35 through which bolts 36 (FIG. 4) pass to attach the assembly to the mounting bosses 4 and 5.

The magnets 3 themselves are mounted on the assemblies to produce alternating field direction N S N S as indicated in FIG. 5. An alternating field is also maintained from magnet assembly to magnet assembly through the device.

Figure 6:
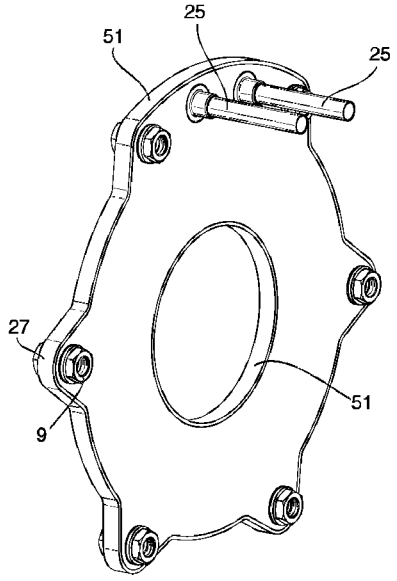
FIG. 6 shows a perspective view of a heat exchanger used in the present invention.
Figure 7:
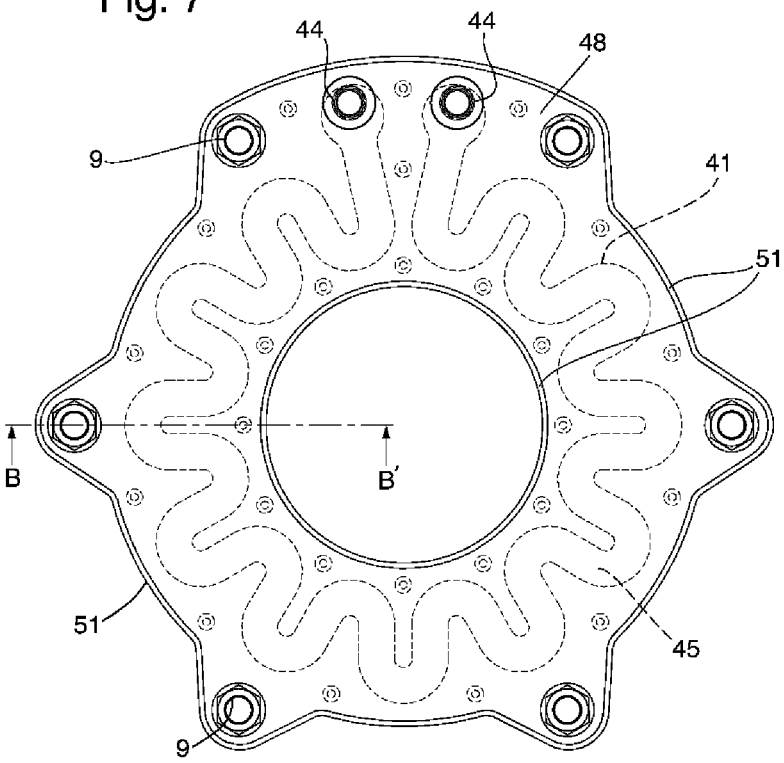
FIG. 7 is an end view of the heat exchanger of FIG. 6 showing the heat transfer fluid path.
Figure 8:
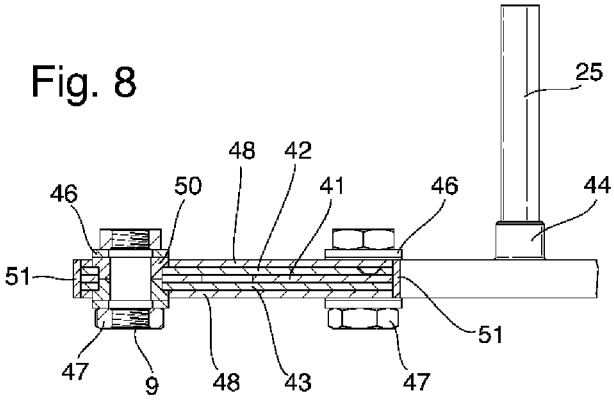
FIG. 8 is a section on the line B-B' of FIG. 7.

In FIGS. 6 to 8 the key stationary (non-rotating elements) are described.

The heat exchanger assemblies 26 comprise an inner disc 41 and two outer discs 42 and 43 mounted brazed together, other conventional methods can be used to hold the two outer discs to the inner disc, including welding or screwing, but whatever methods is used it is essential that these discs should be sealed together. These discs (41, 42, 43) are produced from a highly conductive material, in this example copper was used but aluminium and its alloys is also suitable as are various other alloys of copper and other metals. The two outer discs 42 and 43 form the walls of the heat exchanger and the central disc 41 has etched through it a serpentine path 45 in which a heat transfer medium can pass, in this example pressurized water at typically 1 to 3 bar was used. The serpentine path 45 provides large amounts of turbulence as the heat transfer medium passes through it, it also has a large surface area within the discs maximising the opportunity for heat transfer from the discs 41, 42 and 43 to the heat transfer medium. The path 45 in disc 41 is connected to the heat transfer fluid pipes through inlet and or outlet bosses 44. The disc 41 is thus itself a heat exchanger, as are discs 42, and 43 in contact with the fluid in fluid path 45.

The heat exchanger assemblies 26 are mounted rigidly within the device but in such a way that they do not touch or scrape the rotatable disc assemblies 21. 22 and 23, although they must be in very close proximity. To reduce heat loss the heat exchangers must be encased in a highly insulating material. This insulation is indicated by item number 51 around the periphery of the heat exchanger assembly, and materials 48 covering the faces of the heat exchanger assembly. The material used was a compressed fibre sheet 3 mm thick. There are many alternatives, the main criterion in selection being that the material should be of sufficient thickness to insulate but also be sufficiently thin to allow close proximity of the heat exchanger assembly to the maximum flux density of the magnets 3. Heat loss through conduction must also be reduced in the mounting of the heat exchangers. The bars 9 mount the heat exchanger assembles in position. As the mounting of the heat exchangers can be a route for conductive heat loss, the bars 9 are isolated from the discs 41, 42 and 43 by mounting bushes 50 the bushes being produced from a suitably insulating but structural material. The bars 9 are threaded and are held in place in the wings 27 of the heat exchanger assembly 26 by nuts 47 bearing on washers 46. By turning the mounting nuts 47, the position of the heat exchangers can be adjusted to ensure optimum proximity of the rotatable disc assemblies 21, 22, and 23.

It can be seen, especially in FIG. 7, that the bosses 44 forming the entry and exit for fluid into the fluid path 45 are disposed close together on the periphery of the first disc and the fluid path 45 passes through the first disc 41 in a sinuous serpentine manner in the plane of the disc substantially all the way the central aperture to receive the driving shaft (13 in FIG. 1). In this way heat transfer from the first disc 41 is very efficient.

In operation, the rotation of input shaft 13 turn the rotatable disc assemblies 21, 22 and 23 causing a magnetic flux to pass through the heat exchanger discs 41, 42, 43. This induces current flow in the discs and generates heat. The heat generated is transferred to heat transfer fluid (in this example pressurized water) flowing through the serpentine path 45 in disc 41. By continually pumping the heat transfer fluid through the serpentine path 45, heat will be removed from the heat generator through the heat transfer fluid pipes 25 for use.

Although in the example pressurized water was used as the heat transfer fluid. Anti-freeze or coolants can be added to the water to increase its boiling temperature and to prevent freezing in inactive periods. Water vapour (steam) could also be used; liquid water would be pumped in to the path 45, and raised to steam before exiting. In a commercial heating system the heat generator could be part of a pressurized closed loop system with a pump fitted as part of the unit. Although for many applications water would be the most cost effective option as the heat transfer medium, other heat transfer fluids can be used. For example, mineral oils that have a higher boiling point than water may be advantageous where substantial quantities of heat are being generated and need to be removed from the heat exchanger(s).

The magnetic flux density can be varied. This can be very useful when the generator is connected to a wind turbine. One device to control the magnetic flux density works on the same principles as a centrifugal governor. Weights are attached to the shaft 13 on mechanical linkages. As rotational speed increases, the weights are flung outwards under centrifugal force. The transmitted force from this can then push the outermost rotatable disc assemblies 21 and 23 via further conventional mechanical linkages closer to the heat exchanger assemblies 26 increasing the flux density, such that they absorb more power.

With a wind turbine application it is highly likely the blades will need to spin without any generator load when starting. An adjustment to allow the magnets to be backed off will reduce generator load on the turbine rotor and improve starting in low winds.

As mentioned earlier, the up and down motion found in some a wave energy generators may make it easier to implement the invention, if the discs 41, 42 and 43 described in the figures were placed by plates, with the magnets (3) driven up and down with respect to the heat exchanger thus from the output of such a device.

The invention claimed is:

1. A heat generator comprising:

a heat exchanger disposed around a shaft which rotates a magnetic field to intersect the heat exchanger, the heat exchanger comprising:

a fixed first disc that is electrically conducting and, two further electrically conducting fixed discs, the fixed first disc comprising a fluid path therein, wherein heat generated in the electrically conducting fixed discs by induction as a result of rotating the magnetic field is transferred to any fluid in the fluid path, and wherein the heat exchanger is disposed between a pair of further discs mounted on the shaft and rotating with rotation of the shaft, the pair of further discs having magnets mounted on their surfaces that face the heat exchanger.

2. The heat generator of claim 1 wherein an entry and an exit to the fluid path within the fixed first disc are disposed close together on a periphery of the first fixed disc.

3. The heat generator of claim 1 wherein the fluid path is sinuous.

4. The heat generator of claim 1 wherein the fluid path is serpentine.

5. The heat generator of claim 1 wherein the heat generator comprises a plurality of said heat exchangers and in which any of the further discs that is between heat exchangers has magnets disposed on both sides of the disc.

6. The heat generator of claim 1 wherein the magnets are permanent magnets radially in which one pole is disposed radially of the second pole with respect to the shaft.

7. The heat generator of claim 6 wherein outermost poles alternate between north and south.

8. The heat generator of claim 1 wherein the heat generator includes adjustment means to move the relative position of the said further discs on the shaft with respect to the heat exchanger.

9. The heat generator of claim 1 wherein each of the said further discs has a ferromagnetic annular disc attached on which magnets are mounted.

10. The heat generator of claim 1 wherein the heat generator is mounted in a frame supporting the heat exchanger(s) but thermally isolated therefrom.

11. The heat generator of claim 10 wherein the outside of the frame is thermally insulated.

12. The heat generator of claim 1 wherein the further discs are thermally insulated.

13. The heat generator of claim 1 wherein the two electrically conducting fixed discs provide walls for the fluid path.

14. A heat generator comprising:

one or more heat exchangers disposed around a shaft, wherein each heat exchanger comprises:

a fixed first disc that is electrically conducting;

two fixed second electrically conducing discs sandwiching the fixed first disc;

the fixed first disc comprising a serpentine fluid path formed therein;

the two fixed second electrically conducting discs providing walls for the fluid path;

a pair of rotatable discs mounted on the shaft;

magnets mounted on the pair of rotatable discs facing the one or more exchangers.

15. The heat generator of claim 14 wherein the pair of rotatable discs are ferromagnetic and additionally comprise an annular disc on which permanent magnets are mounted.

16. The heat generator of claim 14 comprising two more heat exchangers wherein pairs of heat exchangers have a common rotatable disc between them; wherein each heat exchanger is disposed between a pair of rotatable discs; and, wherein each common rotatable disc has magnets disposed facing each of the heat exchanges which it faces.

* * * * *